United States Patent [19]

Stern

[11] Patent Number: 4,890,750

[45] Date of Patent: Jan. 2, 1990

[54] PORTAL CRANE

[75] Inventor: Joseph E. Stern, Franklin, Wis.

[73] Assignee: Harnischfeger Corporation, Brookfield, Wis.

[21] Appl. No.: 281,721

[22] Filed: Dec. 9, 1988

[51] Int. Cl.[4] ..... B66C 5/02

[52] U.S. Cl. ..... 212/153; 105/163.2; 212/218; 212/219

[58] Field of Search ..... 212/153, 218, 219; 105/163.2, 171; 104/126

[56] References Cited

U.S. PATENT DOCUMENTS

| | | | |
|---|---|---|---|
| Re. 10,833 | 5/1887 | Murgatroyd | 212/219 |
| 903,806 | 11/1908 | Andresen | 212/219 |
| 4,358,020 | 11/1982 | Thiele | 212/153 |
| 4,505,207 | 3/1985 | Borgaric et al. | 105/171 |

*Primary Examiner*—Sherman D. Basinger
*Assistant Examiner*—Thomas J. Brahan
*Attorney, Agent, or Firm*—Richard C. Ruppin

[57] ABSTRACT

A multilegged portal crane is disclosed in which a plurality of legs including first, second and third spaced apart legs are affixed to a frame with each leg extending between the frame and a different one of a plurality of rails. Each leg has a pair of wheels at a base end, spaced apart in the direction in the length of the rails and rotatable along the rails. A first leg of the plurality of legs has a higher level of rigidity than the other legs which are more flexible relative to the first leg. Means for sensing skew of the crane is mounted on the first leg and the first leg is positioned between the second and third legs such that, for a predetermined amount of skew of the crane determined by the sensing means on the first leg, the skew movement of the second and third legs relative to the first leg is less than the skew movement of the second and third legs relative to each other. Only one of the legs is rigid and the other two are flexible. The rigid leg and the frame will follow irregularities and the rail upon which the rigid leg is mounted and the frame will move with the rigid leg and the wheels due to the irregularities. The flexible legs will flex to permit their wheels to also follow irregularities on their tracks and not become derailed and permit the rigid leg and the frame to move along with the irregularities of the rail on which the first leg is mounted.

13 Claims, 3 Drawing Sheets

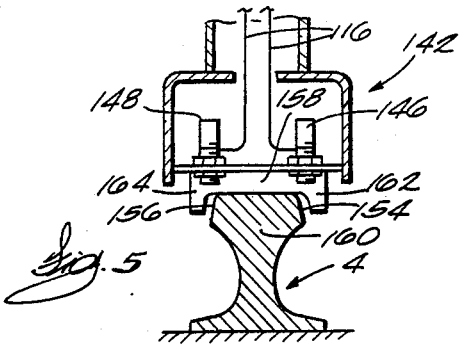
Fig. 5
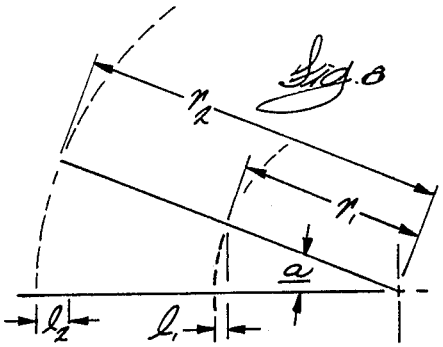
Fig. 8
Fig. 6
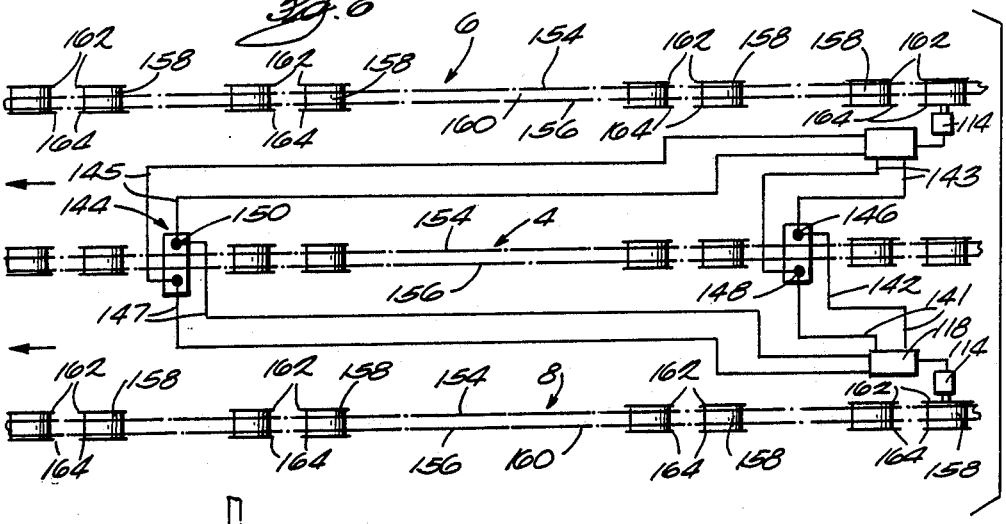
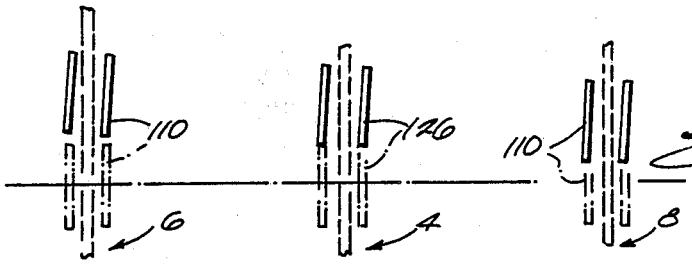
Fig. 7A
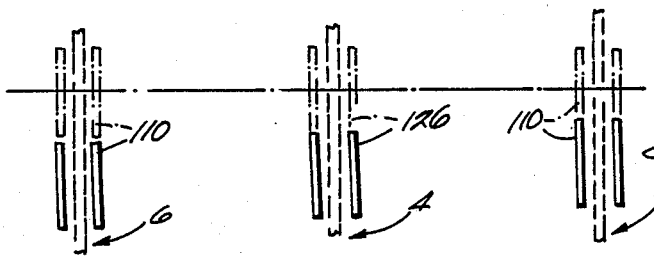
Fig. 7B

PORTAL CRANE

FIELD OF THE INVENTION

This invention relates to portal type cranes in which supporting legs travel on generally parallel rails. More particularly, the invention relates to multiple legged portal cranes spanning particularly large storage areas.

BACKGROUND OF THE INVENTION

Portal cranes having a pair of legs travelable on generally parallel rails and spanning material storage areas are well-known. The demand for portal cranes has been toward increased capacity cranes which has presented various difficult problems in their manufacture and operation. As a result, heights, spans, and speed of operation of portal cranes have increased to thereby permit higher stacking of material, larger storage areas spanned by the crane, and faster lifting, transporting and lowering of material handled by the crane. However, the increased height and spans have required larger crane frame and leg members, additional wheels, and an increase in size of various other components such as motors and brakes. The larger frame and leg members have a negative effect on the capacity of the crane from the point of view of efficiency in that they increase the mass of the crane and thereby reduce the load carrying ability of the crane for its size. Further, the larger crane members present shipping problems in that railroad car sizes and clearances cannot readily handle the larger members. The solution to this problem has been to divide the crane members during manufacture into smaller sections which can be more easily shipped. This, of course, makes both manufacture and assembly in the field more costly.

The capacity of the portal crane to access a greater amount of material can also be increased by increasing the length of the storage area along which the crane travels. However, this creates a problem with the cable system for supplying electrical power to the crane. A longer storage area and thereby a longer travel distance causes a greater voltage drop in the correspondingly longer electrical power cable. Thus, a longer cable as well as a larger diameter cable to avoid the voltage drop is necessary. The cable is carried on a reel located at the center of the travel run of the crane and is payed out as the crane moves in either direction away from the center and taken in as the crane moves toward the center. As the crane passes the center of the run, the reel has to stop taking cable in, a cable guide has to change its position to pay cable out in a different direction, and the reel has to reverse its rotation direction to pay cable out. This operaiton of the reel becomes extremely difficult to reliably accomplish as the reel diameter increases to handle longer and thicker and thereby stiffer cable, and the travel speed of the crane increases.

SUMMARY OF INVENTION

It is a general object of this invention to provide a portal crane having an increased span and thereby access to a larger area without the need to increase crane frame and leg member sizes and which avoids longer crane travel and the associated problems of a larger electrical power supply cable. It is a further object of the invention to provide a portal crane having three legs which cooperate together to enable travel of the crane along substantially parallel rails and with minimum skew movement.

The objects of the inventions are accomplished in a crane travelable along a plurality of generally parallel rails by providing a frame overlying and extending transversely of the rails and a plurality of legs including first, second and third spaced apart legs. Each leg extends between the frame and a different one of the plurality of rails and has a base end on which are mounted at least two spaced apart wheels. The wheels engage and rotate on the rails so that the crane travels along the rails. Sensing means is mounted on the base end of the first leg adjacent the rail which its wheels engage for determining the skew of the crane at the first leg. The first leg has a higher level of rigidity than the second and third legs and is positioned between the second and third legs such that, for a predetermined amount of skew of the crane as determined by the sensing means, the skew movement of the second and third legs relative to the first leg is less than the skew movement of the second and third legs relative to each other. Consequently, the sensing means determines that the crane is skewed at a less amount of skew movement of the second and third legs and thereby at a point in time before the skew of the crane has become so extreme that it is very difficult to correct and before substantial damage has been done to the wheels and rails.

One of the plurality of legs has a greater rigidity or fixed characteristic relative to the frame as compared to the other of the legs. The other legs are hinged or flexible relative to the frame and the first leg. This permits the first leg and the frame to follow irregularities in the rail which the wheels of the first leg follow and the other two legs to flex to permit their wheels to follow irregularities in the tracks followed by their wheels. Further, this arrangement permits movement of the frame and first leg relative to the second and third legs and their wheels so that the wheels of the second and third legs do not derail.

BRIEF DESCRIPTION OF DRAWINGS

Further objects and advantages of the invention will appear when taken in conjunction with the accompanying drawings, in which:

FIG. 5 is a cross-sectional view taken along lines 5—5 of FIG. 2 and showing a skew sensor of the crane;

FIG. 6 is a plan view schematically illustrating the wheels of two legs of the crane and the crane skew sensors;

FIG. 7A is a plan view schematically illustrating the drive wheels of two legs of the crane in a skewed position on the supporting rails, with the skew angle exaggerated for purposes of illustration;

FIG. 7B is a plan view of the wheels of the crane in another skewed position on the supporting rails, with the skew angle exaggerated for purposes of illustraton; and FIG. 8 is a diagram illustrating the degree of skew of the outer wheels about the center wheel of the crane for two different radii of the outside wheels about the center wheel.

DETAILED DESCRIPTION OF THE INVENTION

Figure 1:
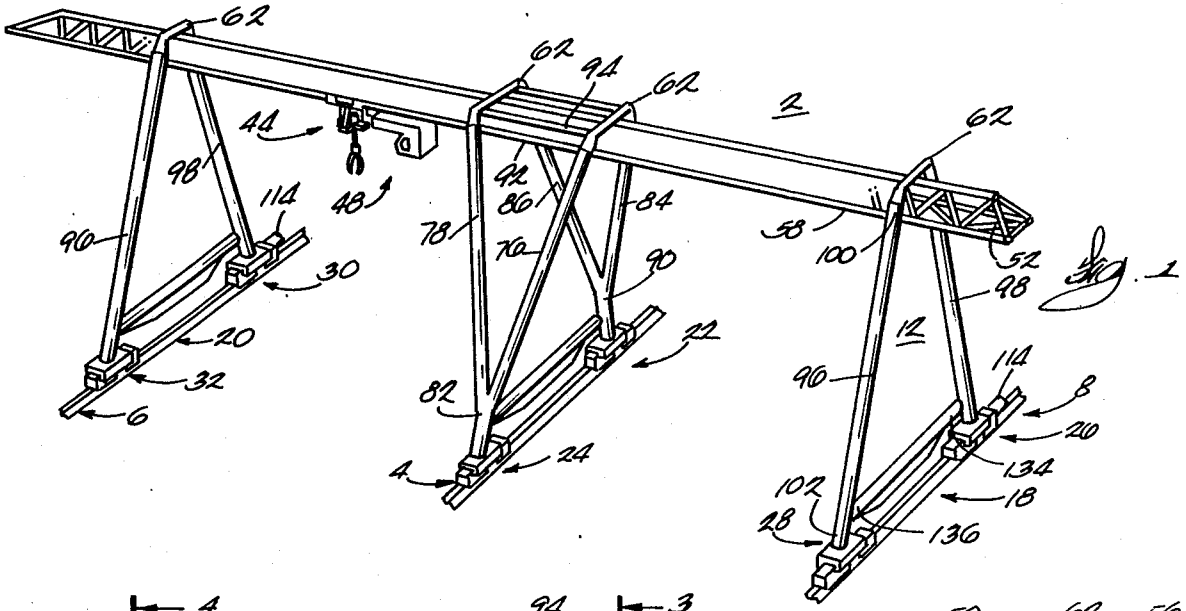
FIG. 1 is a perspective view of the crane according to the invention.

Referring generally to FIGS. 1–4 of the drawing, a portal crane is illustrated as having a frame 2 disposed generally horizontally and overlying three generally parallel rails 4, 6, and 8 extending through a material storage area. Three spaced apart legs 10, 12, 14 are affixed to the frame 2 and respectively extend between the frame and the rails 4, 6, and 8. The legs 10, 12, and 14 each have a lower bases end 16, 18, and 20. The base ends 16, 18, and 20 respectively have opposite ends 130 and 132, 134 and 136, and 138 and 140. Spaced apart wheel assemblies 22 and 24 are respectively affixed to the base 16 at ends 130 and 132, spaced apart wheel assemblies 26 and 28 are respectively affixed to the base 18 at ends 134 and 136, and spaced apart wheel assemblies 30 and 32 are respectively affixed to the base 20 at ends 138 and 140. The wheel assemblies 22, 24 include non-driven wheels 122 and drive wheels 126, and the wheel assemblies 26, 28 and 30, 32 include non-driven wheels 106 and drive wheels 110. The wheel assemblies 22 and 24 engage and ride on the rail 4, the wheel assemblies 26 and 28 engage and ride on the rail 6, and the wheel assemblies 30 and 32 engage and ride on the rail 8. The portal crane thus travels on the wheel assemblies along the rails 4, 6, and 8 through the material storage area. A power cable reel 34 and a cable guide 38 are mounted adjacent the base end 16 of the leg 10, for taking in and paying out a cable 36 for supplying electrical power to the various electrical components of the crane. The cable 36 is attached to a suitable electrical power supply (not shown) adjacent to the rail 4 at approximately the mid-point of the length of the run of the crane along the rails 4, 6 and 8.

The rails 4, 6 and 8 are laid on a bed of ballast and wood ties extending through the storage area in which material such as logs or structural steel are stacked. Although the rails are laid generally parallel to each other, their spaced distances and height relative to each other may nevertheless vary somewhat. These irregularities in the positions of the rails may be due to inaccuracies in laying and to variations in ground elevation, particularly with respect to the farthest apart rails, and to differences in the amount of settling on the ballast bed. Further irregularities in rail position result from stress on the rails as the crane runs along them. These irregularities may be of types in which spacing between rails or elevation from rail to rail differs, or in which a rail is somewhat twisted about its longitudinal axis.

The frame 2 includes a pair of parallel tracks 40 and 42 from which a trolley 44 is supported for travel along the length of the frame. A hoist 46 is mounted on the trolley 44 and includes a grapple hook 48 for raising and lowering a load of material, such as the logs or steel previously mentioned which are to be stored in or removed from the storage area, and holding the material as the trolley 44 moves along the tracks 40 and 42, and the crane moves along the rails of 4, 6, and 8.

Figure 2:
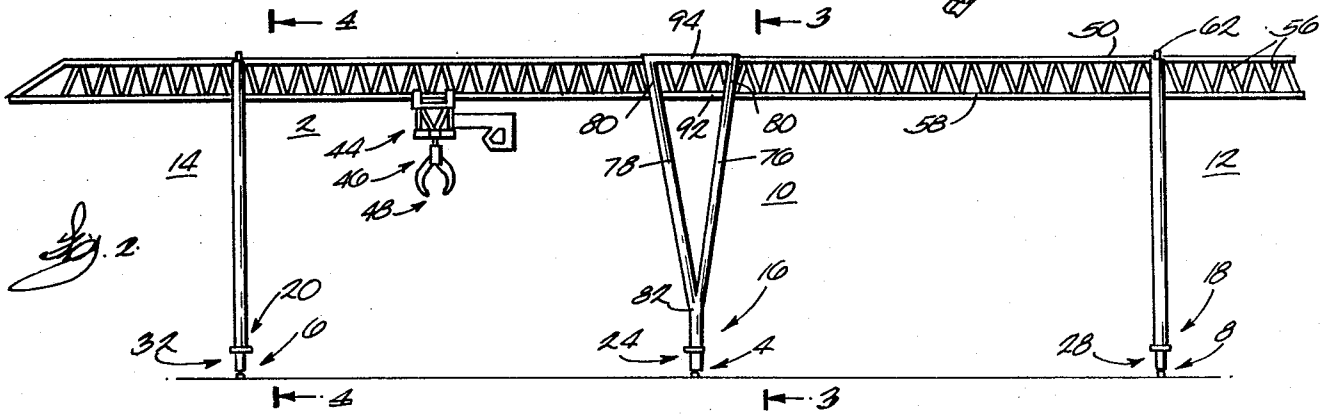
FIG. 2 is a side elevation view of the portal crane shown in FIG. 1.
Figure 4:
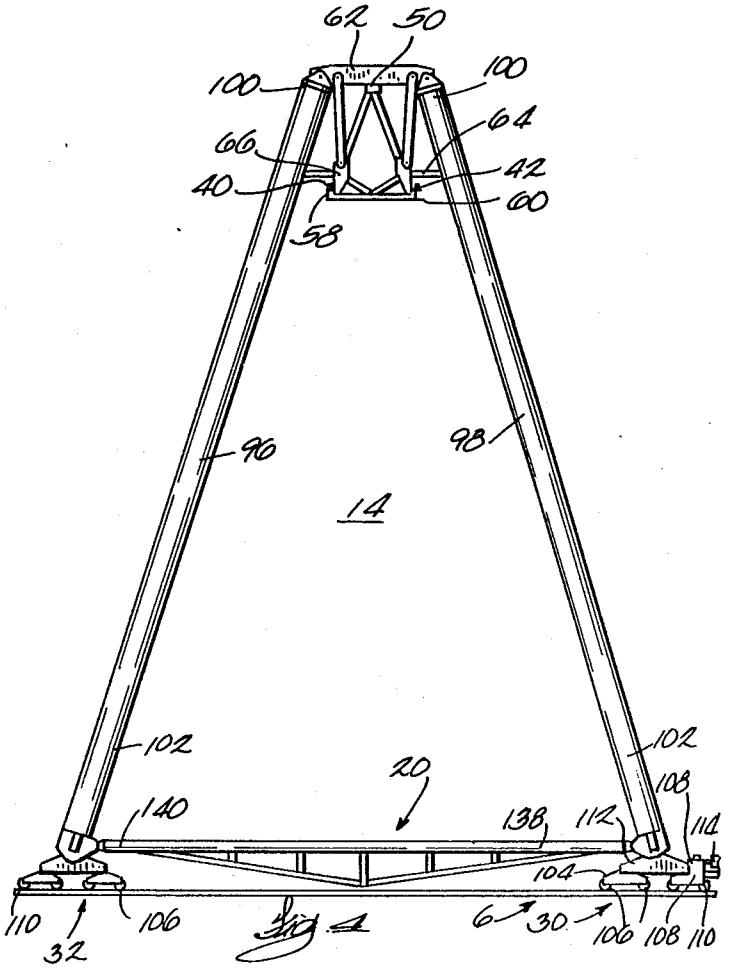
FIG. 4 is a cross-sectional elevation view of the portal crane taken along lines 4—4 in FIG. 2.

The frame 2 is generally of a truss construction having a top chord 50 and two bottom chords 58 and 60 extending substantially the length of the frame 2. Upper diagonal laces 56 are affixed at their opposite ends to the top chord 50 and bottom chords 58 and 60 and have a triangular arrangement as shown in FIG. 2. The frame 2 also includes lower diagonal laces 52 having opposite ends affixed to the bottom chords 58 and 60. The tracks 40 and 42, which support the trolley 44 are respectively affixed to the top surfaces of bottom chords 58 and 60. At each location of a leg 10, 12, and 14, the frame also includes at least one support beam 62 affixed to the top chord 50, and a pair of support plates 64 and 66 affixed to one of the bottom chords 58 or 60. Horizontal ties 68 and 70, gussets 54, and vertical ties 72 and 74 are all connected to the plates 64 and 66.

Figure 3:
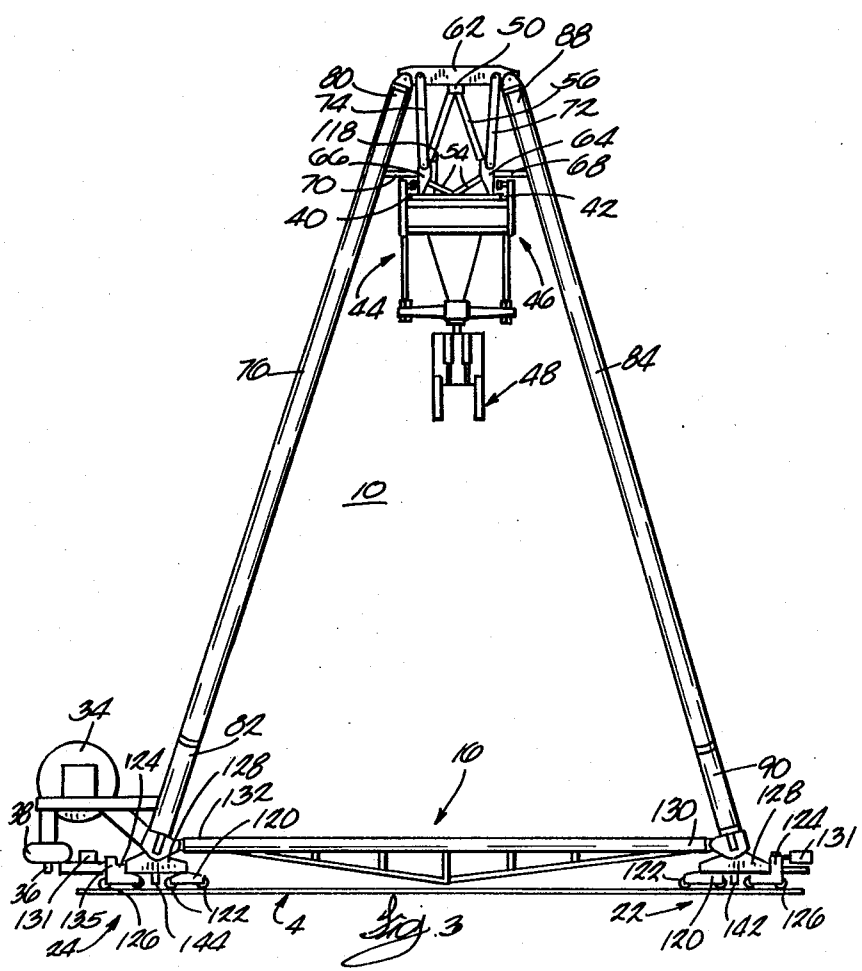
FIG. 3 is a cross-sectional view of the portal crane taken along lines 3—3 in FIG. 2.

The leg 10 is positioned along the length of the frame 2 between the legs 12 and 14, and includes a pair of tubular elongated members 76 and 78 and a pair of elongate tubular members 84 and 86. The tubular members 76 and 78 are affixed at their upper ends 80 to ends of a pair of support beams 62 spaced apart along the length of the frame 2, and are joined at their lower ends 82 to form a triangular support having its apex extending downwardly. The tubular members 84 and 86, similarly to members 76 and 78, are affixed at their upper ends 88 to the opposite ends of the pair of support beams 62 to which the tubular members 76 and 78 are affixed, and are joined at their lower ends 90 to form a triangular support having a downwardly extending apex. As can be seen in FIG. 3, the joined lower ends 82 of the tubular members 76 and 78, and the joined lower ends 90 of the tubular members 84 and 86 are respectively connected to the opposite ends 130 and 132 of the base end 16 and to the wheel assemblies 22 and 24 to form a substantially triangular double leg support for the frame 2. As can also be seen in FIGS. 1 and 2, the tubular members 76 and 78 and 82 and 84 have cross braces 92 and 94 at their respective upper ends 80 and 90. This construction of the leg 10 results in a highly rigid relatively fixed leg strructure, capable of carrying a substantial load, and which does not provide flexing to permit significant movement of the frame 2 in a direction laterally of the rails 4, 6, and 8.

The outer legs 12 and 14 are substantially identical in construction. Each leg 12 and 14 includes a pair of elongated tubular members 96 and 98 having upper ends 100 and lower ends 102. The upper ends 100 of the tubular members 96 and 98 of each leg 12 and 14 are affixed to the opposite ends of a support beam 62 extending across the frame 2. The lower ends 102 of the tubular members 96 and 98 of leg 12 are joined to the opposite ends 134 and 136 of the base end 18 and to the wheel assemblies 26 and 28. The lower ends 102 of the tubular members 96 and 98 of leg 14 are joined to the opposite ends 136 and 138 of the base end 20 and to the wheel assemblies 30 and 32. Because the outer legs 12 and 14 do not have the inverted triangular structure of the leg 10, the legs 12 and 14 are relatively flexible or hinged in comparison with the leg 10, both at their location of connection to the frame 2 through support beams 62, and along the length of their tubular members 96 and 98. As a consequence, as the crane travels along the rails 4, 6, and 8, the wheels 122 and 126 of the wheel assemblies 22 and 24 of the leg 10 will follow the path of the rail 4 very closely, including following the irregularities in the position of the rail 4. Thus, both the leg 10 and the frame 2 of the crane will have some motion due to irregularities in position of the rail 4, particularly laterally of he rail 4, as the crane travels along the rails. On the other hand, as the legs 12 and 14 travel along the rails 6 and 8, and the wheels 106 and 110 of the wheel assemblies 26 and 28, and 30 and 32 of the legs 12 and 14 follow the irregularities of the rails 6 and 8, the legs 12 and 14 will flex such that the position and movement of the frame 2 will be independent of the movement of the legs 12 and 14 as well as the movement of the wheels 106 and 110 of the legs. Moreover, as the frame 2 moves in response to irregularities in the position of the rail 4, the legs 12 and 14 will flex to accommodate such movement independently of the position of the wheels on the legs 12 and 14. It is quite important that only one leg of the three legs 10, 12, and 14 of the portal crane be of a relatively rigid, fixed construction which in essence forces the frame 2 to follow the irregularities of the rail 4 through the leg 10. If a second leg were of a similar rigid nature requiring the frame to move in accord with irregularities in the rail of the second rigid leg, in the frequent instances where the irregularities in the two supporting rails required a different degree or direction of movement of the frame 2, there would be no accommodating flexibility to permit two different types or directions of movement of the two rigid legs. This would lead to a high degree of stress and wear on the rails and crane structure, and possible derailing of the legs.

The wheel assemblies 26 and 28 of leg 12, and 30 and 32 of leg 14 are substantially identical. Consequently identical components are designated by the same numerals and only one of the wheel assemblies will be described in detail. With reference to wheel assembly 30, the assembly includes an idler truck 104 on which the nondriven wheels 106 are rotatably supported and a drive truck 108 on which the drive wheels 110 are rotatably supported. The idler and drive trucks are connected together as an assembly, and also to the base end 20 of leg 14, by an equalizer frame 112 which distributes the load on the tubular member 98 between the two trucks. A drive motor and brake 114 for driving the wheels 110 and stopping or slowing the drive motor and thereby the wheels 106 and 110 are mounted on an extension of the drive truck 108. A control 118 for controlling the operation of the motor and brake 114 is mounted on the frame 2 above the leg 10. The wheel assembles 22 and 24 mounted at opposite ends 130 and 132 of the base end 16 of leg 10 each include an idler truck 120 carrying the nondriven wheels 122, a drive truck 124 carrying the drive wheels 126, and an equalizer frame 128 connected to the trucks 120 and 124 and also connected to the base end 16 of the leg 10. A drive motor and brake 131 are mounted on an extension of each of the drive trucks 124. The motor and brake are also controlled by control 118. The wheels 106, 110 and the wheels 122, 126 each have cylindrical portions 158 engaging heads 160 of one of the rails 4, 6 and 8 and spaced flanges 162, 164 facing opposite sides 154, 156 of one of the rails, as can best be seen in FIGS. 5 and 6.

With reference to FIGS. 3, 5 and 6, a skew sensor 142 is shown mounted on equalizer frame 128 of wheel assembly 22 of leg 10 and a skew sensor 144 is shown mounted on equalizer frame 128 of wheel assembly 24 of leg 10. The sensor 142 has a pair of proximity switches 146, 148 and the sensor 144 has a pair of proximity switches 150, 152. The mounting of the sensors 142 and 144 on the equalizer frames of wheel assemblies 22 and 24 is such that the proximity switches 146 and 148 respectively sense the presence of opposite sides 154 and 156 of the rail 4 and the proximity switches 150 and 152 respectively also sense the presence of opposite sides 154 and 156 of the rail 4. Electrical connections 141 and 143, shown schematically in FIG. 6, are provided between the proximity switches 146, 148 and drive controls 118 for wheel assemblies 26 and 30 respectively on legs 12 and 14. Electrical connections 145 and 147 are provided between the proximity switches 150, 152 and drive controls 118 for wheel assemblies 26 and 30. In the operation of the proximity switches, when the wheels 122 and 126 adjacent switches 146, 148 and 150, 152 respectively on wheel assemblies 22 and 24 are running in a direction parallel to the rail 4 so that the crane is in a non-skewed condition, all switches will produce zero output signale, i.e. no output signals, to the controls 118. This is an indication that the switches do not sense the rail sides 154 and 156 and the crane therefore is not skewed. If the crane is moving in the direction of the arrows shown in FIG. 6 and becomes skewed in a counterclockwise direction, as shown in FIG. 6, so that the switches 148 and 150 now do sense the presence of a rail side, the signals to the controls 118 will cause the brake of the motor and brake 114 on leg 12 to be applied to slow the movement of leg 12 and correct the skew. Alternately, or, in addition, the motor speed of motor and brake 114 on leg 14 can be increased to correct the skew. Skew of the crane in a clockwise direction is corrected in the same manner except that switches 146 and 152 sense the presence of a rail side and the brake of motor and brake 114 on leg 14 is applied to slow leg 14 or the motor speed of motor and brake 114 on leg 12 is increased to corrrect the skew.

The skew sensors 142 and 144 are mounted on the trucks 22 and 24 of the rigid leg 10 only, because the wheels 122 and 126 of the leg 10, when running in a non-skewed condition, will relatively closely follow the direction of the rail 4. Thus, if the wheels 122 and 126 become skewed from the direction of the rail 4, the skewed condition can be readily detected by the skew sensors 142 and 144. On the other hand, the flexible characteristic of the legs 12 and 14 results in their wheels 106 and 110 moving about on their respective supporting rails 6 and 8, such that false indications of skewing would result if skew sensors were mounted on the equalizers 112. Thus, detecting skewing of the crane is preferably based on sensing skew of only the rigid leg of the crane.

With reference to FIGS. 7A and 7B, wheels 110 engaging the rails 6 and 8 and wheels 126 engaging the rail 4, are shown turned or rotated in a skewed direction for one skewed position of the crane in FIG. 7A and in another rotated direction for a second skewed position of the crane in FIG. 7B. In each of the FIGS. 7A and 7B, the wheels 126 and 110 are also shown in phantom lines in a non-skewed position. In moving from a non-skewed position to either of the skewed positions of the crane shown in FIGS. 7A and 7B, the crane has rotated about the vertical axis of leg 10 and the legs 12 and 14 have also rotated about the vertical axis of leg 10. As the crane turns toward one of its skewed positions, the sensors on the equalizers carrying the wheels 126 will sense the skew and provide an output indication to the controls 118 for use in correcting the skew. Placing the sensors 142 and 144 on the leg 10 between the legs 12 and 14, and most desirably centering the sensors 142 and 144 and therefore centering leg 10 between the legs 12 and 14, permits detecting of skew rotation of the legs 12 and 14 at a minimal amount of turning of the legs 12 and 14 due to the consequent relatively short radius of turning of the legs 12 and 14 about the leg 10. This is the case because, for a predetermined change in the position of the wheels relative to the side of the rail 4, sensed by the sensors 142 and 144 as indicative of skew movement of the crane, the relatively small radius of turning between the leg 10 and the leg 12 or the leg 14 results in a correspondingly small lateral change in position of the flanges 162 and 164 of the wheels 106 and 110 toward or away from the rails 6 and 8. In contrast, if the sensors 142 and 144 were located on either of the outside legs 12 or 14, for example leg 12, the skew rotation radius between legs 12 and 14 would result in a relatively large lateral movement of the flanges 162 and 164 of the wheels 106 and 110 on leg 14, for a predetermined change in lateral movement of the wheels on leg 12 sensed by the sensors 142 and 144, necessary to sense skew.

In FIG. 8, a schematic diagram is shown in which the short turning radius $r_1$ represents the shorter skew rotation radius of an outside leg 12 or 14 about the intermediate leg 10, and the long radius $r_2$ represents the skew rotation radius of an outside leg 12 or 14 about the other outside side leg. From the diagram, it can readily be seen that for a given angle a of skew rotation, which is exaggerated for illustrative purposes, which produces a predetermined change in the position of the skew sensors relative to the sensed rail side, the lateral movement of the wheel flanges for the short radius $r_1$ is the lateral distance $l_1$ and the lateral movement of the wheel flanges for the long radius $r_2$ s the large lateral distance $l_2$. From FIG. 8, it can readily be seen that positioning the sensors 142, 144 and 150, 152 on the leg 10 between the legs 12 and 14, permits sensing of skew movement at a much lesser amount of lateral or turning skew movement than if the sensors were positioned on one of the outer legs 12 or 14.

A further aspect of the invention is that, since the flexible legs 12 and 14 must accommodate the close following travel of the wheels of leg 10 along the rail 4, it is desirable that the distance variations between the rail 6 and the rail 4, and the distance variations between rail 8 and the rail 4 be minimized as much as possible during the laying of the rails 4, 6, and 8. As previously discussed, such variation in distance can be caused by lack of accuracy in rail laying, change in ground contour, or change in ground composition between the rail locations. Both the accuracy error and changes in contour or composition of the ground can be, in most cases, minimized by correspondingly minimizing the distance between the laying position of the rails. This can best be accomplished by laying the rail 4 carrying the rigid leg 10 between the rails 6 and 8 carrying the flexible legs 12 and 14.

It will be understood that the foregoing description of the present invention is for purposes of illustration only, and that the invention is susceptible to a number of modifications or changes, none of which entail any departure from the spirit and scope of the present invention, as defined in the hereto appended claims.

What is claimed is:

1. A crane supported on and travelable along a plurality of generally parallel rails, the crane being susceptible to becoming skewed relative to the rails, comprising:

a frame overlying and extending transversely of the plurality of rails;

a plurality of legs including first, second and third spaced apart legs affixed to the frame, each leg extending between the frame and a different one of said plurality of rails, each leg having a base end and at least two rail engaging rotatable wheels attached to the base end and spaced apart in the direction of the length of the rails whereby the crane travels along the rails as the wheels rotate;

the first leg having a higher level of rigidity than the second and third legs;

sensing means mounted on the base end of the first leg adjacent the rail engaged by the wheels attached to the base end of the first leg for determining the skew of the crane at the first leg; and the first leg is positioned between the second and third legs such that, for a predetermined amount of skew of the crane determined by the sensing means, the skew movement of the second and third legs relative to the first leg is less that the skew movement of the second and third legs relative to each other whereby the sensing means determines that the crane is skewed at such lesser amount of skew movement of the second and third legs.

2. The crane according to claim 1 wherein:

each of the plurality of rails have irregularities in their position;

the first leg and the frame closely follow the irregularities of the rail engaged by the wheels of the first leg due to said higher level of rigidity of the first leg; and the second and third legs are flexible relative to the first leg such that the frame and first leg are free to move relative to the second and third legs and the wheels of the second and third legs.

3. The crane according to claim 1 or 2 where the first leg is the only leg having said higher level of rigidity.

4. The crane according to claim 1 or 2 wherein:

the skew movement of the crane is in a circular direction; and the radii of movement of the second and third legs respectively about the first leg during said skew movement is less than the radii of movement of the second and third legs respectively about each other.

5. The crane according to claim 1 or 2 wherein the first leg is equidistant between the second and third legs.

6. A crane supported on and travelable along a plurality of generally parallel rails comprising:

a frame overlying and extending transversely of the plurality of rails;

first, second and third spaced apart legs afixed to the frame, each leg extending between the frame and a different one of said plurality of rails, each leg having a base end and at least two rail engaging rotatable wheels attached to the base end and spaced apart in the direction of the length of the rails whereby the crane travels along the rails as the wheels rotate;

the first leg being fixed relative to the frame and the second and third legs being hinged relative to the frame whereby the first leg provides greater strength to the crane than the second and third legs and the latter legs provide flexibility to the crane;

the crane having a position in which the first, second and third legs are generally parallel with the rails and a skewed position in which the first, second and third legs are at an angle to the rails, the first leg being rotatable about a vertical axis to said angle and the second and third legs being movable simultaneously with the first leg along a circumferential path about the axis to said angle;

sensing means responsive to said rotation of the first leg for detecting skew of the crane; and the first leg is positioned between the second and third legs such that the distance of movement along the circumferential path of the second and third legs is a minimum distance for said rotation of the first leg whereby sensing of the rotation of the first leg as the crane moves toward the skewed position provides an indication of skew at a minimum skew movement of the second and third legs.

7. The crane according to claim 6 wherein:

each of the plurality of rails have irregularities in their position;

the first leg and the frame closely follow the irregularities of the rail engaged by the wheels of the first leg due to said higher level of rigidity of the first leg; and the second and third legs are flexible relative to the first leg such that the frame and first leg are free to move relative to the second and third legs and the wheels of the second and third legs.

8. The crane according to claim 6 or 7 wherein the first leg is the only leg having said higher level of rigidity.

9. The crane according to claim 6 or 7 wherein:

the skew movement of the crane is in a circular directon; and the radii of movement of the second and third legs respectively about the first leg during said skew movement is less than the radii of movement of the second and third legs respectively about each other.

10. The crane according to claim 6 or 7 wherein the first leg is equidistant between the second and third legs.

11. A crane supported on and travelable along a plurality of rails having generally parallel spaced apart positions comprising:

a frame overlying and extending transversely of the plurality of rails;

each of the plurality of rails having irregularities in their position including variations from the parallel position;

a plurality of legs including first, second, and third spaced apart legs affixed to the frame and respectively extending between the frame and a first, second and third one of said plurality of raisl, each leg having a base end and at least two rail engaging rotatable wheels attached to the base end and spaced apart in the direction of the length of the rails whereby the crane travels along the rails as the wheels rotate;

the first leg having a higher level of rigidity than the second and third legs whereby the first leg provides greater strength to the crane than the second and third legs, the first leg and the frame closely following the irregularities of the first rail as the crane travels along the plurality of rails;

the second leg is flexibly movable relative to the first leg to permit movement of the wheels of the second leg relative to the frame, due to irregularities of the second rails, and to permit movement of the frame and first leg including the wheels of the first leg relative to the wheels of the second leg, due to irregularities of the first rail; and the third leg is flexibly movable relative to the first leg to permit movement of the wheels of the third leg relative to the frame, due to irregularities of the third rail, and to permit movement of the frame and first leg including the wheels of the first leg relative to the wheels of the third leg, due to irregularities of the first rail.

12. The crane according to claim 11 wherein the first leg is the only leg having said higher level of rigidity.

13. The crane according to claim 11 and 12 wherein the first leg is positioned between the second and third legs whereby the strength provided to the crane by the first leg is better distributed to the entire crane.

* * * * *